US008776651B2

(12) United States Patent
Marti et al.

(10) Patent No.: US 8,776,651 B2
(45) Date of Patent: Jul. 15, 2014

(54) PROCESS FOR WORKING OF WORK-PIECES BY MEANS OF CUTTING FLUID-JET

(75) Inventors: Daniel Marti, Ammerzwil (CH); Frank Pude, Solothurn (CH); Daniel Hauptmann, Zofingen (CH)

(73) Assignee: Bystronic Laser AG, Niederoenz (CH)

( * ) Notice: Subject to any disclaimer, the term of this patent is extended or adjusted under 35 U.S.C. 154(b) by 316 days.

(21) Appl. No.: 13/201,459

(22) PCT Filed: Feb. 24, 2010

(86) PCT No.: PCT/IB2010/050805

§ 371 (c)(1),
(2), (4) Date: Sep. 30, 2011

(87) PCT Pub. No.: WO2010/097761

PCT Pub. Date: Sep. 2, 2010

(65) Prior Publication Data

US 2012/0042761 A1 Feb. 23, 2012

Related U.S. Application Data

(60) Provisional application No. 61/155,147, filed on Feb. 24, 2009.

(30) Foreign Application Priority Data

Feb. 24, 2009 (CH) ..... 279/2009

(51) Int. Cl.
*B26F 3/00* (2006.01)

(52) U.S. Cl.
USPC ..... 83/13; 83/78; 83/99; 83/177

(58) Field of Classification Search
USPC ..... 83/83, 73, 13, 99, 98, 466.1, 451; 451/38
See application file for complete search history.

(56) References Cited

U.S. PATENT DOCUMENTS 4,738,174 A 4/1988 Bloomquist
4,949,610 A 8/1990 Jones et al.

(Continued)

FOREIGN PATENT DOCUMENTS

DE 2846785 A1 12/1979
DE 3910295 A1 10/1990

(Continued)

OTHER PUBLICATIONS

ByJet Classic Brochure, "The affordable, highly functional, and precise waterjet cutting system for all standard applications," of Bystronic Laser AG, Niederoenz, Switzerland, 4pp., copyright 2010.

(Continued)

*Primary Examiner* — Omar Flores Sanchez
(74) *Attorney, Agent, or Firm* — George Kapsalas; Patentbuero Paul Rosenich AG

(57) ABSTRACT

A process and a cutting machine for working of lying work pieces, particularly plates, glass-sheets, etc. on a machine-tool by means of a cutting fluid-jet (3), particularly of a laser-jet or a high-pressure water-jet on a lattice-like support (9). At least one fixed work piece is cut by the fluid-jet (3), especially water jet exiting from at least one first nozzle (2), so that the work piece (1 *a*) is preferably separated by a cut gap (7) from a rest piece (1 *b*). The respective working position of the nozzle (2) relative the work piece (1 *a*) is controlled. For hindering a tilting of the work piece (1 *a*) and/or the rest piece (1 *b*) during the processing of the work piece (1 *a*), border-fixing and distance-holding elements (8) are associated with the cut gap (7) in such a manner, that the neighboring border-fixing and distance-holding elements (8) are arranged from each other in a distance depending on the outline of the work piece (1 *a*) and/or of a respective length of the cut gap (7). The border-fixing and distance-holding means (8) are attached to the cut gap (7) or are introduced into the cut gap (7). The material of the border-fixing and distance-holding elements (8) is selected preferably from the following group of materials: mesh-able adhesives, materials containing adhesive and/or elastic materials.

22 Claims, 3 Drawing Sheets

(56) References Cited

U.S. PATENT DOCUMENTS

| | | | | |
|---|---|---|---|---|
| 5,643,058 | A * | 7/1997 | Erichsen et al. | 451/99 |
| 5,782,673 | A | 7/1998 | Warehime | |
| 6,037,106 | A | 3/2000 | Komatsu | |
| 6,299,510 | B1 | 10/2001 | Massenburg | |
| 6,325,059 | B1 | 12/2001 | Tieber | |
| 6,379,214 | B1 | 4/2002 | Stewart et al. | |
| 6,565,420 | B2 | 5/2003 | Lisec | |
| 6,593,541 | B1 | 7/2003 | Herren | |
| 6,663,465 | B2 | 12/2003 | Gross | |
| 7,008,293 | B2 * | 3/2006 | Kurogouchi | 451/2 |
| 7,040,629 | B2 | 5/2006 | Horisberger | |
| 7,121,918 | B2 | 10/2006 | Marti et al. | |
| 7,578,210 | B2 * | 8/2009 | Sciulli et al. | 73/866.5 |
| 7,703,363 | B2 * | 4/2010 | Knaupp et al. | 83/177 |
| 7,803,036 | B2 * | 9/2010 | Sciulli et al. | 451/9 |
| 8,449,350 | B2 * | 5/2013 | Pei | 451/38 |

FOREIGN PATENT DOCUMENTS

| | | | |
|---|---|---|---|
| DE | 102004053939 | A1 | 4/2006 |
| DE | 102004053939 | B4 | 6/2007 |
| EP | 0176911 | A1 | 4/1986 |
| EP | 176911 | A1 | 4/1986 |
| EP | 0983827 | A1 | 3/2000 |
| EP | 983827 | A1 | 3/2000 |
| EP | 1110686 | A2 | 6/2001 |
| EP | 1172189 | A2 | 1/2002 |
| EP | 1172189 | A3 | 3/2002 |
| EP | 1110686 | A3 | 3/2003 |
| EP | 1522391 | A2 | 4/2005 |

OTHER PUBLICATIONS

ByJet Brochure, "The flexible waterjet cutting system for demanding applications," of Bystronic Laser AG, Niederoenz, Switzerland, 8pp., undated.

Waterjet Cutting Brochure, "An alternative production technology," of Bystronic Laser AG, Niederoenz, Switzerland, 12pp., copyright 2010.

Waterjet Cutting Brochure, "The perfect complement to milling," of Bystronic Laser AG, Niederoenz, Switzerland, 12pp., copyright 2010.

PCT International Search Report and Written Opinion from WO2010/097761A1 parent PCT application to the present application; mailed Jun. 8, 2010 by WIPO. (in English).

ISR of Swiss(CH) Patent Office in Priority Application no. CH0279/2009, dated Jun. 12, 2009.

* cited by examiner

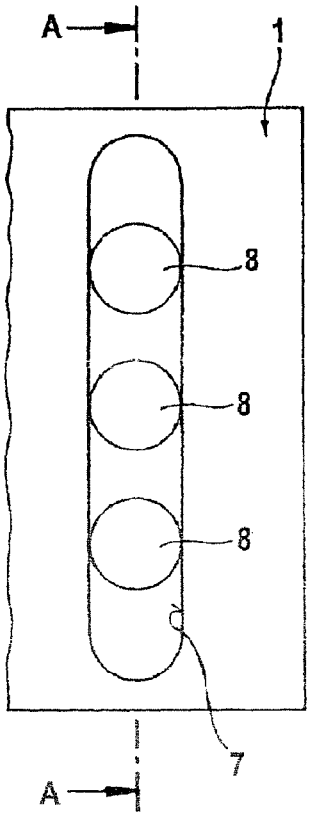
Fig. 5A
Fig. 5B
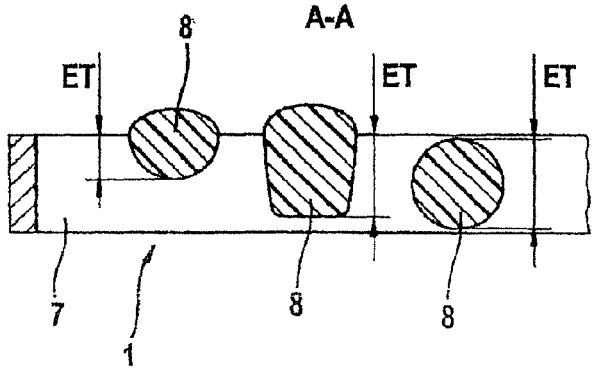
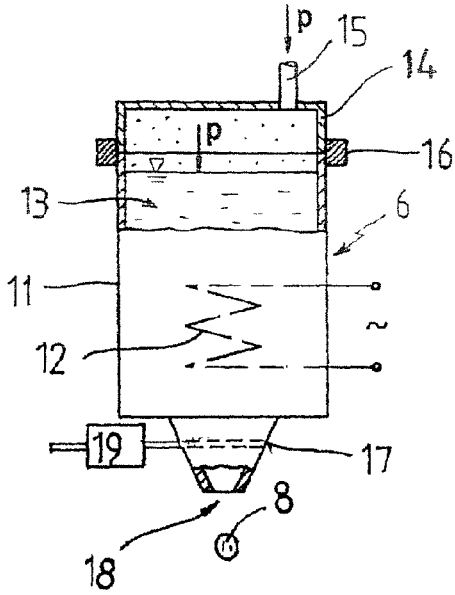
Fig. 6
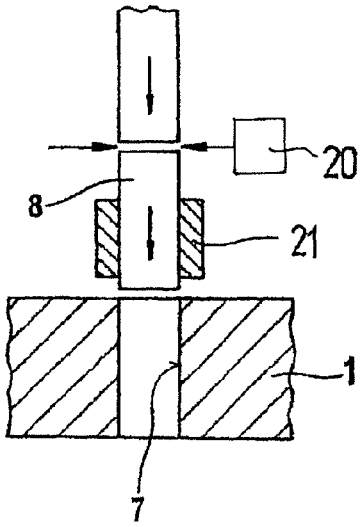
Fig. 7

PROCESS FOR WORKING OF WORK-PIECES BY MEANS OF CUTTING FLUID-JET

CROSS-REFERENCE TO RELATED APPLICATIONS

This application is a section 371 national-phase entry of PCT International application No. PCT/IB2010/050805 filed on Feb. 24, 2010 and published as WO2010/097761A1 on Sep. 2, 2010; application No. PCT/IB2010/050805 claims benefit of priority to Swiss application No. 279/2009 filed on Feb. 24, 2009, and also claims benefit as a non-provisional of prior U.S. provisional application No. 61/155,147 filed on Feb. 24, 2009; the entireties of PCT International application No. PCT/IB2010/050805, of Swiss application no. 279/2009 and of prior U.S. provisional application No. 61/155,147 are all expressly incorporated herein by reference, for all intents and purposes, as if identically set forth in full herein.

TECHNICAL FIELD

This invention relates to a process for working of work pieces, especially plates, glass sheets and similar products, by means of a cutting fluid-jet, especially water-jet. Furthermore, the invention also relates to a cutting machine for carrying out the above process.

BACKGROUND ART

Nowadays, under known fluid-jet processes, planar work pieces are mostly processed especially cut, by means of a high pressure water-jet. For example, a brochure (without any publication date) of the present Applicant (Bystronic Laser AG, CH-3362 Niederönz) disclosed a universal cutting system capable for cutting with fluidjets comprising water alone and water with abrasive material, as well. This water-jet cutting system has one or more cutting head(s) arranged above a water basin on a moveable cutting carriage controlled by a CNC system, and a high pressure pump feeds the cutting heads with water having a nominal pressure of at most 4000 bar.

In order to reduce the off-times, a further machine-tool was proposed in the patent specification EP-1,522,391, which comprises a folding wall on a water basin and can receive charges (working units, cassettes) prepared by a feeding station.

The U.S. Pat. No. 4,738,174 discloses a high pressure water-jet process for working of planar work pieces arranged on a supporting grid, wherein the work piece has been cut by means of the water-jet. In this solution, pins are provided for orienting the work piece on the supporting grid.

Furthermore, in a cutting system according to the DE-3, 910,295, adhesive tapes are used for fixing work pieces during their cutting by means of a water-jet.

A further water-jet system for cutting glass-sheets is known from the EP-1,110,686, wherein the water-jet exiting from a nozzle is directed onto the glass sheet to be cut. The known cutting process of the glass-sheet by the water-jet is often implemented with horizontal arrangement of the glass-sheets and below the glass sheet a water-bed is provided, and its water surface is arranged in a distance under the glass-sheet. In the water-bed, supports are provided, protruding above the water surface, on which supports the glass sheet lies. During cutting of glass-sheets, the glass-sheet is fixed and the water-jet is moved between the work piece and the rest piece along a given cutting contour.

The company LISEC proposed a process, wherein exclusively vertical or steeply obliquely arranged glass-sheets are cut. In this technology, a problem appears which would not appear with lying glass sheets: by the weight of the upper separated glass sheet part lying above the cut gap (work piece or rest piece) could slip downwards into the cut gap and, besides, in the last area of the cut gap produces an undefined glass break. In order to prevent this break, a wedge introducing process was developed by LISEC, in which a distance holder in form of an adhesive wedge is introduced into the cut gap, and thereby the upper glass sheet has been supported in relation to the lower one. So the upper glass sheet cannot sink undefined into the gap.

If LISEC would cut lying (horizontal) glass-sheets instead of standing (vertical) glass sheets, this breaking risk would not appear at all. That is why; the above wedge-introducing process of LISEC could not be used by a man skilled in the art in horizontal cutting processes.

The EP-1,172,189 discloses a similar solution for cutting plate materials, in particular glass, ceramics, marble, aluminum, steel, wood and composite material plates, by means of a high-pressure water jet. The plate is kept in vertical position on two tables placed endwise and separated by an inter-space wide enough to let a cutting tool pass. During the cutting step adhesive material is injected into the just-carried-out cut gap to hold a distance between the two edges of the cut gap, thereby the upper sheet is temporary supported in relation to the lower one. Due to the technological differences this solution would not be used with horizontal cutting processes by a man skilled in the art.

SUMMARY OF INVENTION

The inventor of the present invention has recognized for the first time that there is a drawback of the known working technologies with lying work pieces, that is, the work pieces can be tilted from their nominal plane by the impacts of the exiting and reflected water-jets.

On the other hand, according to our observation, not only the bending forces of the water-jets, but due to the water-jets during the cutting step also vibrations are of bigger importance, as to the quality of the cutting gap and the quality of the final surfaces of the work piece. The bending forces and vibrations cause at least working dimensional variations; however, they can also lead to the waste cutting of the work piece. The above mentioned bending or tilting effect leads as a rule to the loss of work pieces, because they arrive uncontrolled in a cutting station or in a water basin being under the cutting station, where in a given case they may break or they are miscut by succession cutting steps.

It is to be noted that the intended meaning of the term "lying work piece" in the following disclosure is: a horizontal or near to horizontal (slightly obliquely lying) position of the work-piece to be processed.

Therefore, the object of the present invention is to eliminate the above disadvantages, that is, to provide an improved process for water-jet processing of lying work pieces, by which the quality of the working, particularly the cutting quality can be raised even according to the highest claims of the respective customers. In addition, the forces appearing due to the water-jets on the lying work piece and causing the particularly harmful mutual tilting of the cut halves (work piece and rest pieces) should be eliminated.

Thereby those problems are also to be solved, which arise from the thrown out and reflected water-jets, as well as from the volume parts of the water of the basin being set in motion by the water-jets.

The above object has been solved by the present invention according to the features of the versions of the invention.

The invention includes a measure that for locking against tilting of the work piece during its working, e.g. cutting, in a distance depending on the outline (contour) of the work piece and/or the respective length of a cut gap, in each case a fixing and distance element is arranged on the work piece and/or a fixing and distance element is introduced in the cut gap. These fixing and distance means, or equivalently titled fixing and spacing means, are made preferably of an adhesive, or materials containing adhesive.

The fact that adhesives can be similar to those ones, which are used by LISEC to a completely another task, namely for inhibiting the sliding down effect of the standing glass plates, seems to be clear as long as the present invention has been understood. In this respect, we note that it is also seen as an invention to use the adhesive device of LISEC for sticking down the cut gaps at lying (horizontal) work pieces.

In many cases, the vibrations (and not only the bending forces) which appear during the cutting of a work piece due to the use of the water-jet, are of bigger importance. It follows from the fact that the work piece and the rest piece implement mutually oscillatory motions during the cutting process. On the other hand, during the cutting step these oscillations at the border of the work piece change constantly along the cut gap. The biggest border oscillations (amplitudes) can appear as a rule at the end of the cut gap.

This phenomenon has been completely eliminated by the present invention. In order to reach the desired working and cutting quality, and in addition, to be able to eliminate the vibrations (relative swinging motion of the work piece and the rest piece) and also the bending or tilting forces, special means for border-fixing and distance-holding have been proposed according to the present invention. Because this solution is based on a completely other task than the above cited Lisec technology with standing (vertical) plates, its transfer into the present technology cannot be an obvious act.

By virtue of the invention the working or cutting process as such is not limited to a complete separating step; the invention can also be used for working processes, wherein the work pieces need not to cut through completely.

Preferably the introduced fixing and distance elements can also be applied even after the cutting step, during the following other treatments and/or transportation of the work pieces, to prevent tipping the work piece or the cut work piece parts or the rest pieces. As an adhesive material for the fixing and distance elements could be used particularly hot glue, two-component adhesive, or other cross-linked or rubber-elastic materials, for example elastomer.

The border-fixing and distance-holding means or material should be preferably elastic to be able to damp the problematic vibrations and forces. The border-fixing and distance-holding means can be made from a material, e.g. elastomer, rubber, adhesive or other materials and/or they are to be made in such a form that in their condition inserted into the cut gap, they should be elastic, adherent and/or they should have a damping feature in a predetermined degree. This elasticity or damping effect is important first of all for the primary processing, particularly for the cutting of the work piece, but in a given case, it is also advantageous to secondary treatments (e.g. grinding, polishing, etc.) and to transportation.

According to another aspect of the invention, it is particularly advantageous if elastomers are used to the border-fixing and distance-holding means, on the basis of their elasticity and anti-vibration feature. Furthermore, to the border-fixing and distance-holding means swell-able elastomers are also capable, which reduce their volume after a compression and/or under a roller pressure for some seconds. They can be simply applied preferably by filling them into the cut gap, and they can be quickly removed from the gap after the processing without any problem.

Elastomers or cross-linked adhesive materials are also preferred to the border-fixing and distance-holding means. In a given case, they can also serve for temporary fixation of the work pieces on the supporting frame.

An adhesive can be applied preferably under a pre-selected pressure, for which hot adhesive with known devices, like heated container, etc. can be chosen.

A particularly good effect of the border-fixing and distance-holding means can be reached by their mutually overlapping arrangement on the work piece surface.

Modern adhesives can be often hardened by light. These are preferably hardened by a ultra-violet light, or in a given case, particularly by expanded laser-beam.

Other adhesives, particularly two-component-adhesives can be hardened among others by means of ultrasonic. Therefore, an ultrasonic catheter (probe) can also be used within the framework of the invention for hardening the adhesive points dispensed by means of a nozzle. The ultrasonic catheter could be associated with the adhesive dispensing nozzle or could be moved behind the adhesive dispensing nozzle, and after the ultrasonic treatment the adhesive can harden.

Preferably a surplus in adhesive can be applied in a given case, which supports itself in a form of a mushroom above and on the both cut halves.

Prefabricated border-fixing and distance-holding means let themselves introduce easily in the uniform cut gap, particularly if they are formed a little bit conical or wedge-shaped opposite their front side. Besides, they can be fed into the feeding nozzle singly, and for example they can be blown by means of compressed air or they can be put by means of mechanical clamping arm into the cut gap.

In a further embodiment, it is particularly favorable if a strip material is fed and cut off to form the border-fixing and distance-holding elements, and then these elements are introduced into the cut gap. Thereby an alternative technology is provided.

A lateral connection of the work pieces with the support frame, that is, with the water permeable support, can be also realized with the proposed border-fixing and distance-holding means. If these are used to a grid or a framework support, then a wedging up of the work piece takes place opposite these. Alternatively, a taping of the work piece is also possible; however, this is associated with a subsequent required cleaning step, provided that the adhesives have not low adhesion.

The supply of the border-fixing and distance-holding means is preferably carried out by means of a clamping arm which is connected to the nozzle and being controlled mechanically and/or electrically or electronically; this feeding arm is preferably arranged in the vicinity of the water-jet cutting head.

In a preferred application, the introducing of the border-fixing and distance-holding means is controlled by a numeric control system of the machine-tool. Of course the introducing step of the border-fixing and distance-holding means can be also controlled manually. In a preferred technology, the device would be controlled first manually and the numeric control values of the points are memorized in order to execute then the putting of the border-fixing and distance-holding elements automatically (teach-in-function) into the gap. In a serial production of the border-fixing and distance-holding means and/or with sensitive ones, and if a high precision working is required, it is advisable to carry out the appropriate routine in a CNC-program and to use automatic control.

BRIEF DESCRIPTION OF THE DRAWINGS

Additional details and characteristic features concerning the invention will be evident from the following description of an example of the invented process with the help of the accompanying exemplary and symbolic drawings, in which:

FIG. 5A is a top view of a cut gap in a work piece, with different fixing and distance-holding elements introduced into the gap under pressure;

FIG. 5B shows a cross-section along the line A-A in FIG. 5A, in which different designs of further embodiments of the fixing and distance-holding means can be seen;

FIG. 6 is a side view of an applicator for dispensing hot adhesive in order to form the fixing and distance-holding elements, partly cut;

FIG. 7 shows a schematic side view of application example for feeding the fixing and distance-holding elements from a stock, partly cut.

In the drawings, the same or equivalent elements are designated with the same reference characters.

DESCRIPTION

Figure 1:
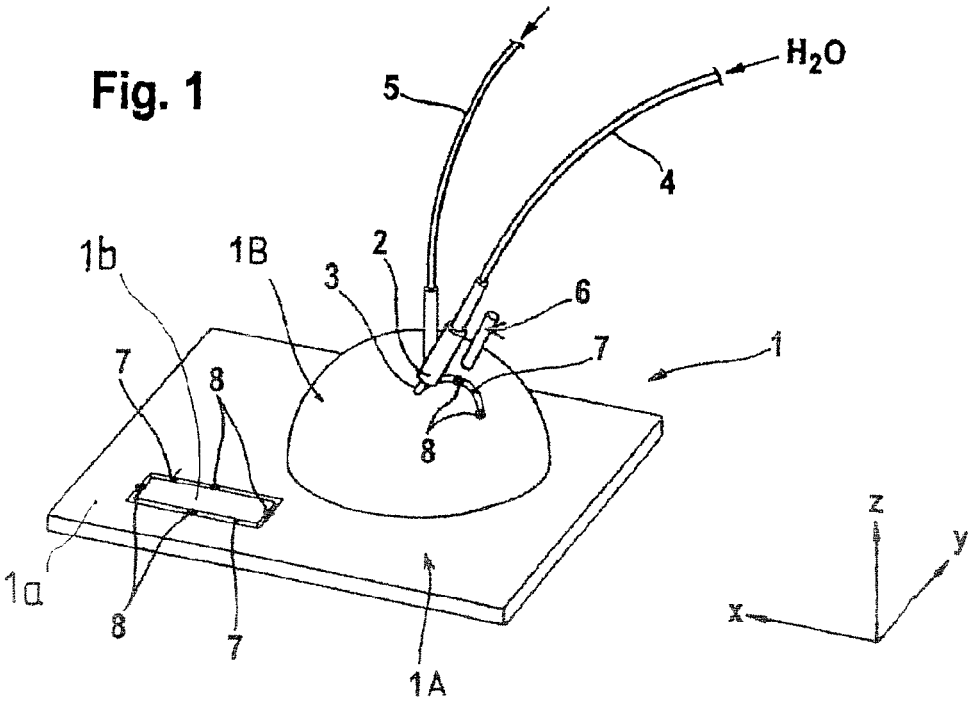
FIG. 1 shows a perspective view of a raw work piece having a three-dimensional portion and a flat portion during an abrasive water-jet cutting process according to the invention, together with a parallel guided applicator for dispensing adhesive points.

In FIG. 1, a three-dimensional raw work piece 1 to be processed (an auto car body part made of steel plate) is illustrated in a perspective view, which comprises in the present case a planar part 1A and a curved part 1B. The treatment, that is, the processing of the raw work piece 1 is carried out by means of a known nozzle 2 provided with a mixing chamber (not shown) for pressurized water and abrasive material. In FIG. 1, a cutting fluid-jet 3, a pressure pipe 4 for water and a supply pipe 5 for abrasive material are also illustrated.

In addition, for carrying out the present procedure an applicator 6 is applied, which follows a predetermined path (cut gap) of the fluid-jet nozzle 2. By means of the fluid-jet 3 a predetermined curved cut gap 7 is prepared first by the shown three-dimensional cutting in the curved part 1B, in a known manner.

According to the invention the applicator 6 has the task to introduce border-fixing and distance-holding elements 8 according to the invention into the cut gap 7 in regular distances from each other and/or in predetermined distances defined according to the work piece 1, for example, by means of a computer-control-system.

In the even part 1A of the raw work piece 1, a rectangular cut gap 7 was then similarly made (it separates the real work piece 1*a* from a rest piece 1*b*) in the second step, and in this cut gap 7 also border-fixing and distance-holding elements 8 according to the invention are introduced or arranged in the predetermined distances from each other (see FIG. 1).

By the application of the border-fixing and distance-holding means 8 according to the invention the edges of the cut gap 7 are fixed in a constant distance from each other; so neither the work piece 1*a* in itself, nor the cut-off rest parts 1*b* can mutually swing out or relatively move, so that thereby a measurable improvement of the processing quality has been reached. Also the preparations and automation of the processing can be made more certain and faster, as it can be seen in FIG. 2, for example.

Figure 2:
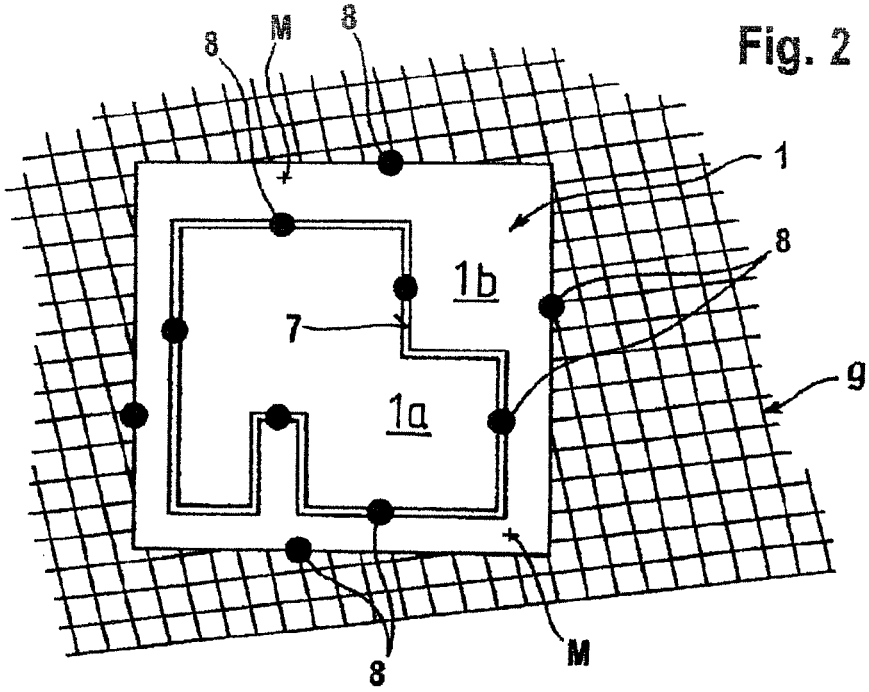
FIG. 2 is a schematic top view of a flat work piece fixed on a permeable support structure with characteristically distributed fixing and distance-holding means in accordance with the invention.

In FIG. 2, as a raw work piece 1a rectangular thin plate is arranged on a lattice-shaped permeable work-piece-supporting frame 9 and it is fastened to the work piece-supporting frame 9 by means of the fixing and distance-holding elements 8 made of an adhesive according to the invention. The same fixing and distance-holding elements 8 have been introduced, one after another, into the gap 7, or have been arranged on the cut gap 7 during the cutting process. The cut gap 7 has here a closed rectangular form.

By this arrangement a sequential processing of the work pieces can be carried out. The preferred distances of the fixing and distance-holding elements 8 are to be seen in FIG. 2, as an example. It is to be noted that here the fixing and distance-holding elements 8 were applied not only for fixing along the cut gap 7, but also for fixing the work piece 1 along its outline on the supporting frame 9.

To assist the orientation (alignment) of the work piece 1 two marks M are provided on the plate (FIG. 2), which assist the optical or magnetic position detection of the work piece 1, for example, and thereby its alignment for the following processing steps.

Figure 3:
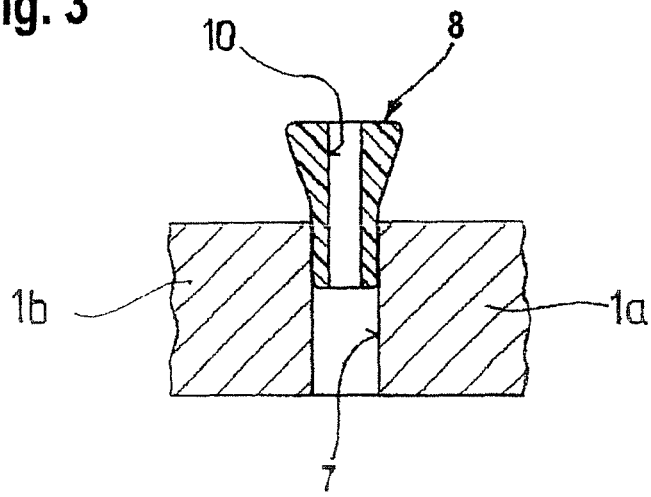
FIG. 3 shows a cross-section of an arrangement comprising a work piece, a cut gap, a rest piece and a prefabricated first embodiment of the fixing and distance-holding element made of swell-able synthetic material in accordance with the invention.

FIG. 3 shows a first prefabricated embodiment of the border- or edge-fixing and distance-holding elements 8 made of a swell-able synthetic material, which is provided with a central opening 10. This opening 10 serves for centering and introducing/pushing the fixing and distance-holding element 8 into the cut gap 7. This embodiment of the fixing and distance-holding element 8 has an upwards widening head portion in its inserted condition (FIG. 3). The material of this fixing and distance-holding element 8 can be compacted (compressed) by pressure briefly, what makes possible its easy introduction into the cut gap 7. With the opening 10 a transportation tool (not illustrated) can cooperate, too. A comparable elastomer material is applied—among others—as cheap ear protectors (noise absorber) in the practice. However, there are alternative materials, which are form-stable on the one hand, and self-adherent on the other hand, so they can be pressed into the cut gap and there they adhere to the cut gap edges.

Figure 4:
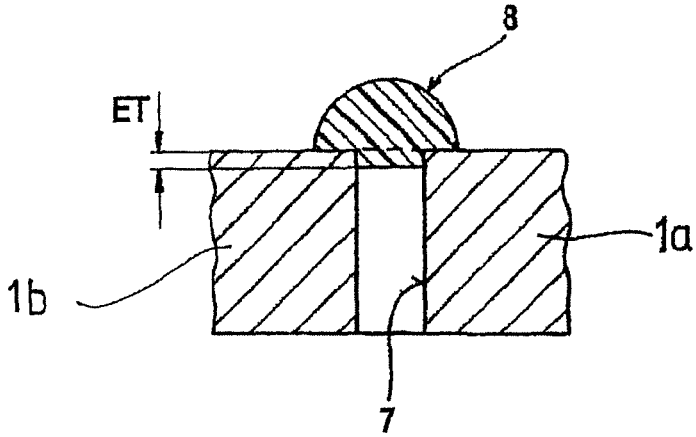
FIG. 4 illustrates a cross-section of an arrangement comprising a work piece, a cut gap, a rest piece and a prefabricated second embodiment of the fixing and distance-holding element made of synthetic material.

In FIG. 4, a further embodiment of the fixing and distance-holding element 8 according to the invention is shown, which can be a prefabricated or an in-situ product made of an after-hardening adhesive. This has—after its application on the surface of the work piece 1—a half-round head 8A and a neck part 8B projecting into the cut gap 7, having a penetration depth ET, which can be preferably at least 30% of the width of the cut gap 7.

By means of the overhanging parts of the mushroom-like head of these fixing and distance-holding elements 8, the neighboring work pieces and/or rest pieces are also fixed from above to downwards, and thereby a particularly effective anti-tilting effect can be reached.

In the symbolic illustrations of FIGS. 5A and 5B, three different further embodiments of the fixing and distance-holding element 8 and according to the invention (made of adhesive, for example) are applied in the same cut gap 7, but these are pressed into the gap 7 each in different degrees. The cross-section (FIG. 5B) shows the application process of the invention after the row, from the left to the right; a small amount of adhesive was applied for the first fixing and distance-holding element 8, a relatively large amount of adhesive was used for the second fixing and distance-holding element 8', and compared to the second element 8, a relatively smaller amount of adhesive was applied to the third fixing and distance-holding element 8" under relatively higher pressure and/or higher feeding rate.

In accordance with the predetermined pressure values and adhesive amounts applied, each of the fixing and distance-holding elements 8, 8' and 8" according to the invention may have different cross-section form and penetration depths ET. In FIG. 5B, it can be recognized, that by means of the different forms and penetration depths ET, ET', ET" of the elements 8, 8' and 8" different damping and fixing effects can be reached, depending on the given application conditions.

FIG. 6 illustrates an embodiment of the applicator 6 in details, which is part of a cutting machine (not illustrated as a whole), and which is suitable for carrying out the technology according to the present invention by using e.g. melted adhesive.

This embodiment of the applicator 6 has an isolated container 11 which can be heat e.g. by an electric heating element 12. In the container 11, there is a melted adhesive material 13, for example hot glue, being heated up to the operating temperature, and it is under a pressure P (for example, under gas pressure or piston pressure). A removable cap 14 is provided on the container 11 for refilling the adhesive material 13, and it also has a supply pipe 15 for pressurized gas, e.g., compressed air. A sealing ring 16 is provided around the cap 14, which keeps the container 11 tight. At the lower end of the container 11 a funnel 17 is formed which serves as an outlet of the container 11, and this outlet is provided with a second nozzle 18 for dispensing the melted adhesive material 13, that is, for forming and introducing the fixing and distance-holding elements 8.

The applicator 6 comprises, preferably, a computer-controlled (by a CNC program) electro-magnetic valve 19 for predetermined and controlled dispensing of the melted adhesive material 13 through the second nozzle 18. By means of this controller the valve 19 can be opened or closed.

So the predetermined amount of the adhesive material 13 can be pressed out through the nozzle 18 by regulating the time for holding the nozzle 18 open, in order to shape the respective fixing and distance-holding elements 8. The preselected values of the pressure P provides different penetration depths ET, ET', ET" for the different fixing and distance-holding elements 8, 8' and 8", as shown in FIG. 5B.

FIG. 7 shows a very simple application example of a further embodiment of the fixing and distance-holding element 8. With this procedure a piece of a flat or round-section path of elongated material 13, especially from a ductile material, e.g. polyvinyl-chloride (PVC) has been inserted into a cut gap 7 for forming the fixing and distance-holding element 8. The inserted portion of the ductile material 13 has been separated before inserting (or after inserting) by means of a known cutting device 20. This technology is illustrated in FIG. 7 schematically, wherein a guiding tube 21 takes over basically the task of the above disclosed applicator 6 (see also FIG. 1).

According to this process a piece of the material 13 of the fixing and distance-holding elements 8 is cut off behind the guiding tube 12 and then it is introduced as the fixing and distance-holding element 8 into the cut gap 7. If the arrangement allows, however, preferably this cutting off step can take place below the guiding tube 21.

The subject-matter of the present invention can be carried out in numerous variants adapted to the current processing circumstances, and it brings a substantial qualitative and quantitative increase in the efficiency of the processing of planar work pieces, particularly glass-sheets or similar products by means of water-jet or other cutting-jet.

On the basis of the above disclosure, the present invention provides an original solution, by means of which the forces which appear when a work piece has been processed with water-jet and cause harmful mutual tilting of the work piece or that of the cut halves at the traditional technologies (due to the reaction of the washbasin water, for example), can be completely eliminated. On the other hand, the cut work piece parts can be solidly fixed and connected to each other by means of the fixing and distance-holding elements 8 according to the invention, for later treatment and/or transportation thereof, without any risk of damage of the work pieces, too. This is also an important additional advantage of the proposed technology in the practice.

The present invention is disclosed mostly on the basis of a few preferred embodiments of a water-jet cutting machine. However, the invention has not been limited to these applications. Although there is not any danger of whirled up washbasin water on the work piece or the rest piece with a laser-jet (laser beam) cutting process, under certain circumstances, depending on the local short time overheating, thermal distortions can occur, which can lead to a position change of the work piece relatively to the rest piece. Therefore, the technology (process and cutting machine) according to the invention can be used with these cutting technologies with advantages, too. Consequently, it does not matter for which cutting fluid-jet technology the invention is used, but the more important aspect is whether this technology is connected with inherent problems which can lead to cutting inaccuracies, and these problems can be eliminated by means of the present invention, especially by means of the proposed edge-fixing and distance-holding means 8 in the cut gap by wedging or gluing.

With the water-jet technologies, the materials used for this wedging or gluing means can preferably be water resistant, while they may be heat-resistant with the laser-beam technologies. Under certain circumstances, the materials are to be elected in such a manner that they can utilize the water and/or the heat for their curing.

The above disclosed embodiments are to be applied therefore also analogously to any application with laser-beam cutting technology or to every other cutting technology which can lead—as a consequence of the applied cutting fluid-jet and its harmful effects—to quality decreases. Therefore the accompanying claims protect any application of the invention with all cutting fluid-jet technologies, too.

LIST OF REFERENCE CHARACTERS

1—Raw work piece (to be processed)
1*a*—Work piece
1*b*—Rest piece
1A—Planar part
1B—Curved part
2—First nozzle (e.g. for fluid-jet)
3—Cutting fluid-jet
4—Pressure pipe (for water)
5—Supply pipe (for abrasive material)
6—Applicator
7—Cut gap
8, 8', 8"—Fixing and distance-holding means/elements

8A—Head
8B—Neck part
9—Work-piece-supporting frame
10—Opening
11—Container
12—Heating element
13—Material (of fixing and distance-holding means 8)
14—Cap
15—Supply pipe (for gas)
16—Sealing ring
17—Funnel
18—Second nozzle (for dispensing the material 13)
19—Valve
20—Cutting device
21—Guiding tube
M—Mark
P—Pressure
ET, ET', ET" Penetration depths (of elements 8, 8', 8")

What is claimed is:

1. A process for handling lying working material to be cut comprising:
laying working material on a support;
cutting the lying material with a stream discharged from a controlled cutting head;
by said step of cutting the lying material, forming a cut gap between a workpiece portion of the lying material and a remaining portion of the lying material;
disposing a plurality of fixing and spacing inserts in the cut gap at spaced intervals; and,
restraining the workpiece portion of the lying material and the remaining portion of the lying material against relative tilting and bending by said fixing and spacing inserts.

2. A process for handling lying workpiece material to be cut as claimed in claim 1, further comprising:
restraining the workpiece portion of the lying material and the remaining portion of the lying material against relative movement by the fixing and spacing inserts.

3. A process for handling lying workpiece material to be cut as claimed in claim 1, further comprising:
cutting the lying material with a high-pressure water jet stream exiting from a nozzle.

4. A process for handling lying workpiece material to be cut as claimed in claim 3, further comprising:
providing a second nozzle with an outlet for dispensing material for fixing and spacing inserts;
guiding the second nozzle at a distance from the high-pressure water jet stream nozzle; and,
introducing the material of a fixing and spacing insert into the cut gap through the second nozzle.

5. A process for handling lying workpiece material to be cut as claimed in claim 4, further comprising:
introducing the material of the fixing and spacing insert into the cut gap to a penetration depth of between 20 to 30 percent of a width of the cut gap.

6. A process for handling lying workpiece material to be cut as claimed in claim 4, further comprising:
discharging the material for a fixing and spacing insert and applying it into the cut gap under a preselected pressure.

7. A process for handling lying workpiece material to be cut as claimed in claim 4, further comprising:
providing a heated and pressurized container in fluid communication with the second nozzle; and,
maintaining the material for a fixing and spacing insert in a flowable state in the container.

8. A process for handling lying workpiece material to be cut as claimed in claim 4, further comprising:
forming a fixing and spacing insert having a connected excess applied-material quantity resting on a surface of the lying workpiece material above the cut gap.

9. A process for handling lying workpiece material to be cut as claimed in claim 1, further comprising:
attaching the plurality of fixing and spacing inserts to the cut gap.

10. A process for handling lying workpiece material to be cut as claimed in claim 9, further comprising:
selecting the material of the fixing and spacing inserts from at least one of the group of materials consisting of hot glues, two-component adhesives, and cross-linked adhesives.

11. A process for handling lying workpiece material to be cut as claimed in claim 9, further comprising:
selecting the material of the fixing and spacing inserts from at least one of the group of materials consisting of light-hardenable adhesive and ultrasonically-hardenable adhesive.

12. A process for handling lying workpiece material to be cut as claimed in claim 1, further comprising:
selecting the material of the fixing and spacing inserts from at least one of the group of materials consisting of cross-linked polymers and rubber-elastic polymers.

13. A process for handling lying workpiece material to be cut as claimed in claim 1, further comprising:
compressing fixing and spacing inserts made of elastomer;
introducing the compressed fixing and spacing inserts into the cut gap; and,
permitting the fixing and spacing inserts to swell in the cut gap.

14. A process for handling lying workpiece material to be cut as claimed in claim 1, further comprising:
providing fixing and spacing inserts of light-hardenable adhesive; and,
hardening the fixing and spacing inserts by exposing them to radiation from a light source selected from at least one of the group consisting of ultraviolet light source and expanded laser beam source.

15. A process for handling lying workpiece material to be cut as claimed in claim 1, further comprising:
selecting the material of the fixing and spacing inserts as ultrasonically-hardenable adhesive;
depositing the fixing and spacing inserts in the cut gap with an adhesive dispensing nozzle; and,
hardening the fixing and spacing inserts with an ultrasonic probe.

16. A process for handling lying workpiece material to be cut as claimed in claim 1, further comprising:
cutting the lying material with a laser jet.

17. A process for handling lying workpiece material to be cut as claimed in claim 1, further comprising:
cutting a section of an elongated material to form a fixing and spacing insert; and,
introducing the cut section of the elongated material into the cut gap.

18. A process for handling lying workpiece material to be cut as claimed in claim 17, further comprising:
selecting the elongated material from at least one of the group of materials consisting of ductile material and plastic material.

19. A process for handling lying workpiece material to be cut as claimed in claim 17, further comprising:
introducing the cut section of the elongated material into the cut gap pneumatically.

20. A process for handling lying workpiece material to be cut as claimed in claim 17, further comprising:

introducing the cut section of the elongated material into the cut gap mechanically.

21. A cutting machine for processing lying workpiece material, comprising:

a high-pressure water jet stream nozzle configured to cut lying material;

an applicator configured to provide material of fixing and spacing inserts to a cut gap in the lying material:

said applicator including a container configured to contain the material of fixing and spacing inserts;

said applicator also including a second nozzle configured to deposit the material of fixing and spacing inserts in a cut gap in the lying material, said second nozzle being in fluid communication with said container;

a valve configured to controllably dispense melted material of the fixing and spacing inserts from said second nozzle; and, a control system operatively connected to the cutting machine, said control system configured to direct said cutting machine to:

cut lying workpiece material with a high-pressure water jet stream exiting from said water jet stream nozzle; and, apply a plurality of the fixing and spacing inserts from said second nozzle to the cut gap in the lying workpiece material.

22. A cutting machine for processing lying workpiece material, comprising:

a high-pressure water jet stream nozzle configured to cut lying material;

an applicator configured to provide material for fixing and spacing inserts to a cut gap in the lying material;

said applicator including a guiding tube configured to guide elongate material stock of fixing and spacing inserts to the cut gap in the lying material;

said applicator including a cutter configured to cut fixing and spacing inserts from the elongate material stock; and, a control system operatively connected to the cutting machine, said control system configured to direct said cutting machine to:

cut lying workpiece material with a high-pressure water jet stream exiting from said water jet stream nozzle; and, apply a plurality of fixing and spacing inserts to the cut gap in the lying workpiece material by activating said cutter to cut the fixing and spacing inserts from the elongate material stock guided by said guiding tube.

* * * * *